United States Patent [19]

Zünd et al.

[11] Patent Number: 4,471,994

[45] Date of Patent: Sep. 18, 1984

[54] ADJUSTABLE CHAIR

[75] Inventors: Karl Zünd, Rebstein, Switzerland; Bert Frey, Runo-Dumenza, Italy

[73] Assignees: Fa. Karl Zünd & Co., AG, Rebstein, Switzerland; Fa. Karl Zünd & Co., AG, Rebstein, Switzerland

[21] Appl. No.: 378,407

[22] Filed: May 14, 1982

[51] Int. Cl.[3] ..... A47C 1/032

[52] U.S. Cl. ..... 297/300; 297/316; 297/320; 297/355

[58] Field of Search ..... 297/320, 316, 353, 354, 297/355, 300, 299

[56] References Cited

U.S. PATENT DOCUMENTS

| | | | |
|---|---|---|---|
| 799,128 | 9/1905 | Wilmot et al. | 297/320 |
| 2,745,467 | 5/1956 | Vale | 297/320 |
| 2,859,799 | 11/1958 | Moore | 297/316 |
| 3,602,537 | 8/1971 | Kerstholt | 297/316 |
| 3,837,704 | 9/1974 | Bauer | 297/353 |
| 4,143,910 | 3/1979 | Geffers et al. | 297/320 |
| 4,200,332 | 4/1980 | Brauning | 297/316 |
| 4,270,797 | 6/1981 | Brauning | 297/316 |

FOREIGN PATENT DOCUMENTS

| | | | |
|---|---|---|---|
| 2501673 | 7/1975 | Fed. Rep. of Germany | 297/354 |
| 1074377 | 10/1954 | France | 297/353 |
| 2085719 | 5/1982 | United Kingdom | 297/316 |

*Primary Examiner*—Francis K. Zugel
*Assistant Examiner*—Mark W. Binder
*Attorney, Agent, or Firm*—Toren & McGeady; Toren & McGeady

[57] ABSTRACT

At a seat carrier 4 of a chair, a backrest 5 is pivotally connected. A seat which rests on the seat carrier 4 and the backrest can be interdependently adjusted in their inclination. For return into the resting position and to fix in any desired position, a gas pressure spring 10 and, if necessary, additional springs 11 are provided. The one end of the gas pressure spring 10 engages at the free end of a thrust lever 15 which is pivotally held at the backrest 5, wherein this pivot axis 7 is arranged at a distance from the pivot axis 6 between the backrest 5 and the seat carrier 4. A lever arm 16 which is pivotally attached at the seat carrier 4 also engages at this thrust lever 15 at a distance from its pivot axis 7. The thrust lever 15 can perform a relative motion with respect to the backrest 5 by means of the arrangement of the lever arm 16. Therefore a relatively small movement of the backrest 5 results in a correspondingly larger movement of the gas pressure spring 10.

13 Claims, 5 Drawing Figures

ADJUSTABLE CHAIR

The invention relates to a chair with a seat and a backrest, wherein at least one bearing surface of the seat and the backrest are adjustable interdependently with respect to a seat carrier which is connected with the pedestal, i.e. are pivotal about an approximately horizontal axis. For the return motion and for the fixation of the desired position, a gas pressure spring and, if necessary, an additional spring which supports the action of the gas pressure spring are provided. These springs are in effective connection on the one side with the seat carrier and on the other side with the backrest wherein at least the gas pressure spring is pivotally attached with its end that faces the backrest at a thrust lever which engages at the backrest.

Already a desk chair is known in which levers which are rigidly attached at the backrest engage at the one end of a gas pressure spring and a compression spring, wherein these rigid levers are pivotal together with the backrest about its pivot axis at the seat carrier. In addition, a plurality of levers is necessary in order to achieve at least a minor transmission of the spring deflection because the swivel motion of the backrest alone is not sufficient to achieve an appropriately large spring deflection. A large spring deflection is of advantage in order to thus achieve a more advantageous spring characteristic.

It is the task of the present invention to create a chair with which in a structurally simple manner an appropriate transmission of the pivotal movement of the backrest on the spring deflection can be achieved.

It is suggested according to the invention that one end of the thrust lever, which is installed between the gas pressure spring and the backrest, is pivotally attached at the backrest at a distance from the pivot axis of the backrest at the seat carrier, and that, at this thrust lever at a distance from its pivot axis, at the backrest a lever arm engages which is pivotally attached at the seat carrier.

In this way it is accomplished that the thrust lever can perform a relative motion with respect to the backrest, wherein this relative motion is caused by the guidance at the additional lever arm. Thus, at a relatively small movement of the backrest a correspondingly larger movement of the gas pressure spring and a possibly additionally arranged spring results, so that the existing spring characteristic can be fully utilized. In addition, with these measures according to the invention a construction can be created in a very small space which is practically maintenance-free and not subject to interference because this construction is achieved with a minimum number of pivot axes and levers.

Further features according to the invention and special advantages are elucidated in the description below with the aid of the drawing. In the drawing FIG. 1 shows a side view of a chair, partially shown in section, wherein to make the figure clearer the seat and backrest as well as the pedestal are not shown.

Figure 1:
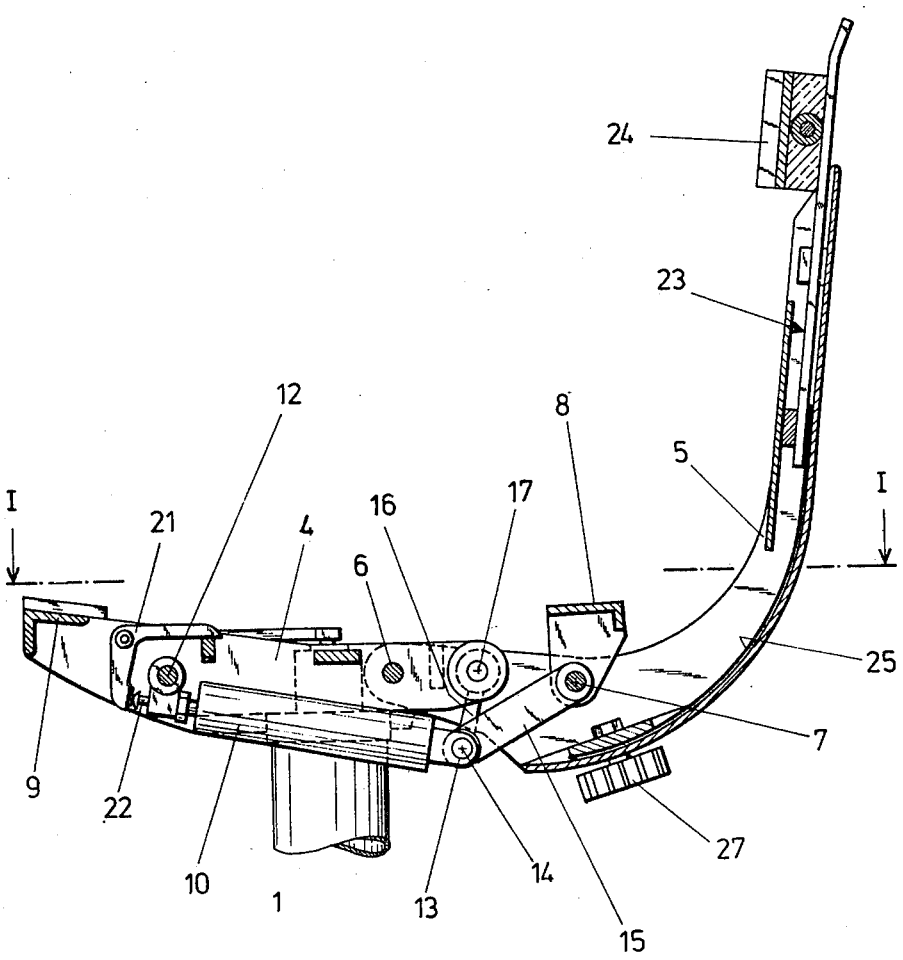
Figure 2:
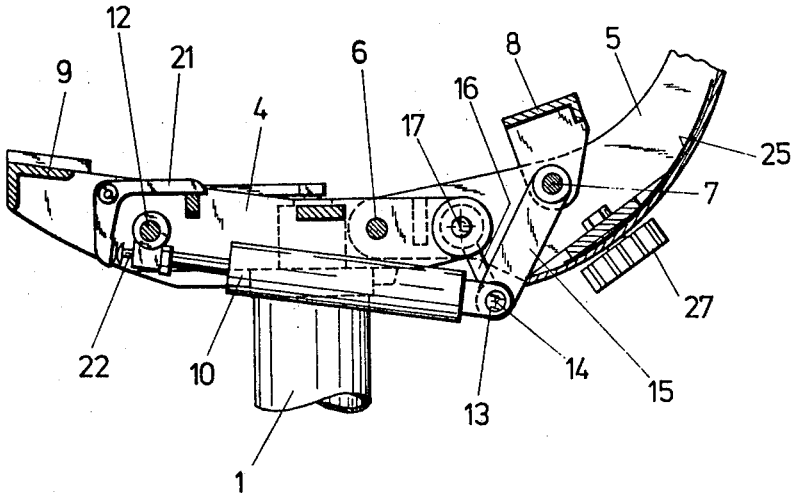
FIG. 2 shows the same view, wherein, however the backrest is in a different position.
Figure 3:
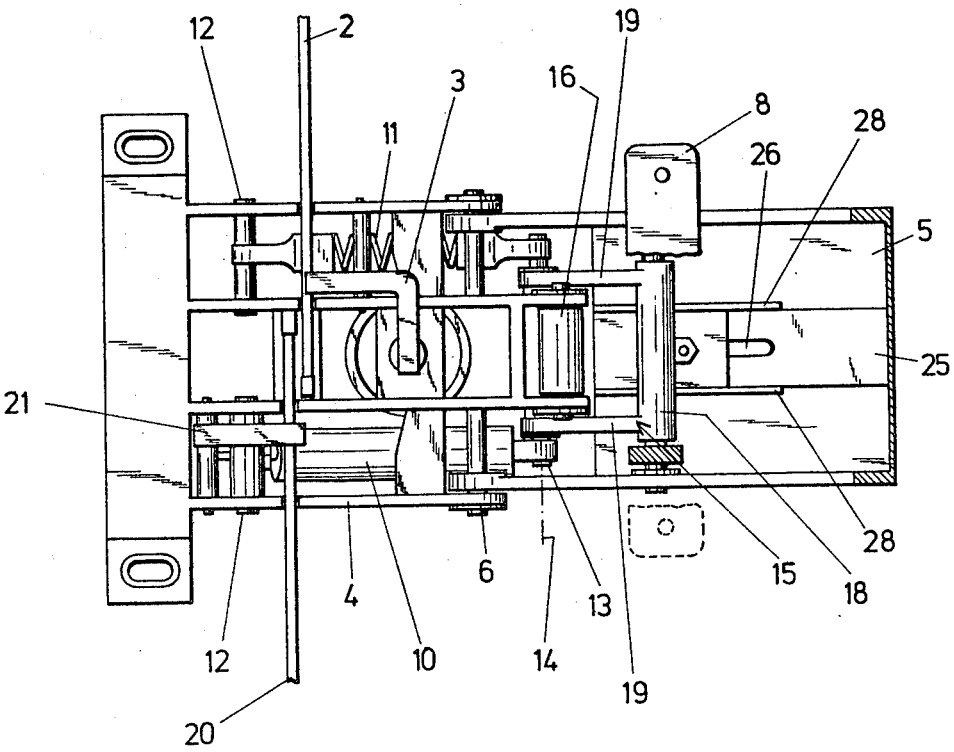
FIG. 3 is a top view on the seat carrier, shown in section along line I—I in FIG. 1.

As already mentioned, in the shown chair the seat, backrest and pedestal are omitted for the sake of clarity. At the pedestal a pipe 1 connects which is equipped with a gas spring, and, if necessary, a compression spring. A vertical adjustment of the chair can be achieved by means of a manual lever 2 and a lever 3 which acts on a valve of the gas pressure spring. The seat carrier 4 is firmly connected at the upper end of the pipe 1. The backrest 5 is connected at the seat carrier 4, wherein these two parts are pivotally connected by means of the pivot axis 6.

At a distance from the pivot axis 6, the rear bearing surface 8 for the seat is supported to be pivotal about the pivot axis 7. The front bearing surface 9 is firmly connected with the seat carrier 4, wherein attachment of the seat at this bearing surface 9 can be achieved by means of a hinge or an elastic member so that the movement of the rear bearing surface 8 can be absorbed. When the backrest 5 is pivoted about the axis 6, the rear bearing surface 8 is accordingly raised or lowered so that, in dependence on the position of the backrest 5, also the seat can be adjusted. This is accomplished particularly also due to the special construction of the backrest 5 which is approximately L-shaped, wherein the lower, horizontal part projects relatively far under the seat so that consequently the pivot axis 6 lies close to the pipe 1 of the chair.

In order to achieve a simple possibility to adjust the backrest and the seat, a gas pressure spring 10 as well as in addition a compression spring 11 are provided which complement one another so that an excellent spring characteristic can be attained. These pressure springs 10 and 11 are pivotal about a front axle 12. The rear ends of the these pressure springs 10 and 11 engage at a bolt 13 which also forms a pivot axis 14. At this bolt 13, a thrust lever 15 also engages whose other end is pivotally held at the backrest 5. Advantageously this thrust lever 15 engages at the same pivot axis 7 as the rear bearing surface 8 for the seat. In any case, this pivot axis 7 must be at a distance from the pivot axis 6 between the backrest 5 and the seat carrier 4.

A lever arm 16 is also provided which on the one side is pivotal about a pivot axis 17 at the stationary seat carrier 4 and on the other side engages at the bolts 13 with the pivot axis 14.

When the backrest is moved, the swivel axis 14 moves in a circular arc about the pivot axis 17, wherein already at a small movement of the backrest 5 a correspondingly increased movement of the pressure springs 10 and 11 is caused. Therefore it is evident that with very simple structural means such a transmission of the adjusting path of the pressure springs 10 and 11 is achieved.

In the shown embodiment, the one end of the lever arm 16 engages at the bolt 13 and is consequently pivotal about the pivot axis 14. It would also be possible within the scope of the invention to let this lever arm 16 engage at another point at the thrust lever 15 wherein, however, this point of engagement must be at a distance from the pivot axis 7 of the thrust lever 15. Thus additional variations can be achieved in the transmission. But the shown embodiment is not only the most simple in view of its construction, but it is also evident that the mechanism requires very little space wherein also particularly during pivoting motion the provided levers and pressure springs do not require a great yielding space. It is also advantageous when the lever arm 16 is shorter than the thrust lever 15 which also contributes to a construction with very limited space requirements and nevertheless a large attainable transmission ratio.

The lever arm 16 is in the shown embodiment of relatively wide construction, viewed in the axial direction, wherein the thrust lever 15 is formed of two extensions 19 which are arranged at a distance from one another and engage at a sleeve 18.

Of course, an actuating mechanism is provided for the gas pressure spring 10 wherein for this purpose a manual lever 20 is arranged below the seat, and by moving this lever an angle lever 21 can be adjusted by means of which then a valve rod 22 of the gas pressure spring 10 can be accordingly activated.

In the chair according to the invention, at the backrest 5 a support member 24 which is vertically adjustable in a guidance 23 is provided for the upholstered part of the backrest, so that the height of the backrest can also be adjusted. To carry out the height adjustment, at the part 24 a flexible band 25 is arranged which advantageously consists of a spring steel. This band 25 has an oblong hole 26, wherein an adjusting screw with a handwheel 27 is passed through this oblong hole. The band 25 therefore is clamped in the desired height, wherein this band 25 in the region of the screw is guided between two guide bars 28.

Figure 4:
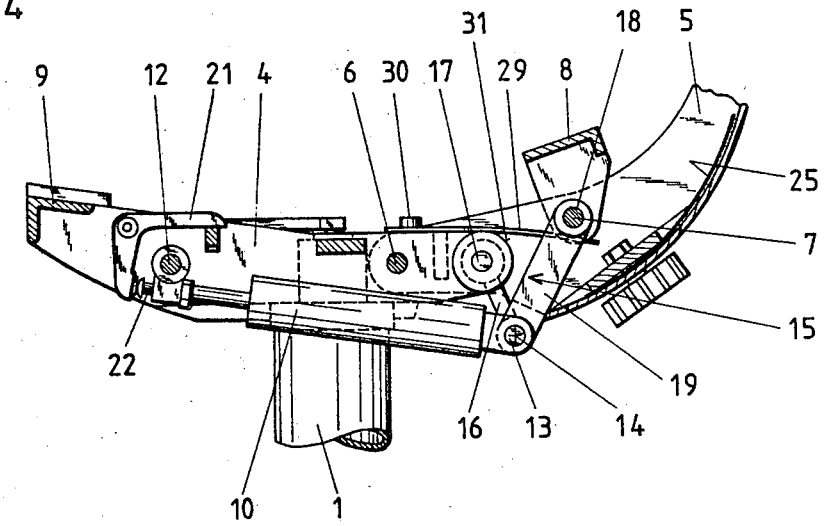
FIGS. 4 and 5 show the same as FIGS. 2 and 3, wherein an additional spring in form of a flat spring is provided.
Figure 5:
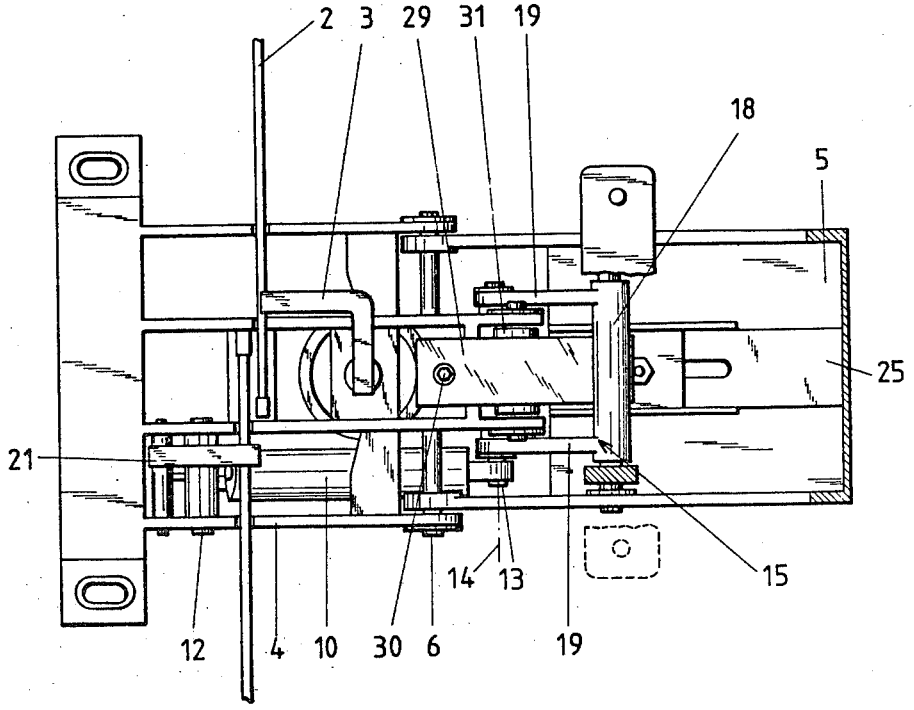

In the embodiment according to FIGS. 4 and 5 the same structural parts are provided so that the same reference numbers were entered in these figures. However, in this variation, instead of the compression spring 11, a flat spring 29 is provided which is attached by means of a screw 30 at the seat carrier. The freely cantilevering end of this flat spring 29 engages below the sleeve 18 of the thrust lever 15 and can also be supported at a sleeve 31 of the lever arm 16. This flat spring 29 supports the gas pressure spring 10 just as the compression spring 11 does in the first embodiment. The further the backrest 5 is swiveled back, the more this flat spring 29 is bent. The flat spring 29 is bent most in a position as shown, for instance, in FIG. 1. The arrangement of such a flat spring 29 is a very simple structure measure, particularly since only a screw attachment of one end of the spring to the seat carrier 4 is required.

Of course other variations may be provided within the scope of the invention in order to support the action of the gas pressure spring 10 by means of additional springs.

In the present invention an interdependent adjustment of the seat and the backrest can be accomplished with relatively simple structural means and in addition it is also very simple to move the upholstered part of the backrest to a desired height and then fix it in this position.

Of course the measures according to the invention can also be achieved by means of different structural changes, as long as the basic requirements are met.

We claim:

1. Work chair including a seat and a backrest and comprising a seat carrier (4) arranged to support the seat of the chair and a backrest support (5) arranged to support the backrest of the chair, said seat carrier and said backrest support being pivotally connected at a first horizontal axis (6), at least one bearing surface (8) for the seat pivotally connected to said backrest support (5) about a second horizontal axis (7), a pedestal (1) secured to and depending downwardly from said seat carrier (4), a gas pressure spring (10) and a screw compression spring (11) are connected between said seat carrier and said backrest support for adjusting the seat and the backrest, a thrust lever (15) pivotally connected to said backrest support, each of said gas pressure spring (10) and screw compression spring (11) has a first end and a second end with the first end of each of said springs pivotally connected to said seat carrier and with the second of each said spring pivotally connected to said thrust lever (15), wherein the improvement comprises that said thrust lever (15) is connected at one end at the second horizontal axis to said backrest and at the other end to the second ends of said springs, said second horizontal axis is parallel to and spaced from said first horizontal axis, and an elongated lever arm (16) having a pair of ends spaced apart in the elongated direction, said lever arm is pivotally secured to said seat carrier adjacent one end thereof and is pivotally connected to said thrust lever adjacent the other end thereof and the location of the pivotal connection of said lever arm (16) and said thrust lever (15) is spaced from the pivotal connection of said thrust lever to said backrest support (5).

2. Work chair, as set forth in claim 1, wherein the other end of said lever arm (16) is pivotally connected to said thrust lever (15) at the pivotal axis of said thrust lever and said springs.

3. Work chair, as set forth in claim 2, wherein said lever arm (16) has a shorter length between its pivotal connections to said seat carrier and said thrust lever than the length of said thrust lever between the pivotal connections thereof to said backrest support and said springs.

4. Work chair, as set forth in claim 1, wherein said bearing surface (8) and said thrust lever (15) are pivotally attached to said backrest at said second horizontal axis (7).

5. A chair having a seat and a backrest, comprising a seat carrier (4) for the seat with said seat carrier having a first side adjacent the front of the seat, a second side adjacent the rear of the seat and a pair of laterally spaced third sides extending between the first and second sides, a backrest support (5) for the backrest extending rearwardly and upwardly from the second side of said seat carrier, said backrest support (5) is pivotally connected to said seat carrier (4) at an approximately horizontal first pivot axis (6) adjacent the second side of said seat carrier, a bearing support (8) for the seat pivotally mounted on said backrest support at an approximately horizontal second pivot axis (7) with said second pivot axis extending across said backrest support and spaced rearwardly from the second side of said seat carrier, spring means for pivoting said backrest support (5), said spring means including at least a gas pressure spring (10), said spring means being connected to said seat carrier and to said backrest support, a thrust lever (15) extending in the first side second side direction of said seat carrier and having a first end and a second end with the first end thereof located closer to the first end of said seat carrier than the second end thereof and said spring means being pivotally connected to the first end of said thrust lever and said backrest support pivotally connected to the second end of said thrust lever, said first and second pivot axes being parallel and spaced apart, and a lever arm (16) having a first end pivotally connected to said seat carrier and a second end pivotally connected to said thrust lever at a location spaced thereon from said second pivot axis and between said first and second pivot axes.

6. A chair, as set forth in claim 5, wherein the first end of said lever arm (16) is pivotally connected about a pivot axis located between said first pivot axis and said second pivot axis.

7. A chair, as set forth in claim 5 or 6, wherein the length of said lever arm (16) between the first and second ends thereof is less than the length of said thrust lever between the first and second ends thereof.

8. A chair, as set forth in claim 5, wherein said bearing support (8) and said thrust lever (15) are pivotally connected to said backrest carrier (5) about said second pivot axis (7).

9. A chair, as set forth in claim 5, including a pedestal formed in part by an upwardly extending pipe, said seat carrier secured to said pipe with said pipe being spaced from the first side and second side of said seat carrier, said gas pressure spring extending approximately horizontally in the direction between the first side and second sides of said seat carrier and said gas pressure spring being pivotally connected to said seat carrier between the first side thereof and said pipe and being connected to said thrust lever on the opposite side of said pipe closer to the second side of said seat carrier.

10. A chair, as set forth in claim 9, wherein said lever arm (16) is pivotally connected to said seat carrier adjacent the second side thereof and extends downwardly therefrom with the second end of said lever arm connected to said thrust lever about the pivot axis of said thrust lever and said gas pressure spring.

11. A chair, as set forth in claim 10, including means mounted on said backrest support for adjusting the height of the backrest.

12. A chair, as set forth in claim 5, wherein said spring means includes a compression spring coextensive with said gas pressure spring and spaced laterally from said gas pressure spring.

13. A chair, as set forth in claim 5, wherein said spring means includes a flat spring spaced laterally from said gas pressure spring and extending from said seat carrier to said backrest support, said flat spring secured to said seat carrier and extending rearwardly therefrom with the rearward end of said flat spring being freely cantilevered and with said flat spring contacting said thrust lever adjacent the free cantilevered end thereof.

* * * * *

UNITED STATES PATENT AND TRADEMARK OFFICE

CERTIFICATE OF CORRECTION

PATENT NO. : 4,471,994

DATED : September 18, 1984

INVENTOR(S) : Karl Zünd, et al

It is certified that error appears in the above-identified patent and that said Letters Patent is hereby corrected as shown below:

Title page, Item [73] should read:

-- Assignee: Fa. Karl Zünd & Co., AG, Rebstein, Switzerland --

Signed and Sealed this

*Nineteenth* Day of *March 1985*

[SEAL]

*Attest:*

DONALD J. QUIGG

*Attesting Officer* *Acting Commissioner of Patents and Trademarks*